US007926294B2

(12) United States Patent
Tsai et al.

(10) Patent No.: US 7,926,294 B2
(45) Date of Patent: Apr. 19, 2011

(54) HYBRID THERMOELECTRIC-VAPOR COMPRESSION SYSTEM

(75) Inventors: Chung-Yi Tsai, Arden Hills, MN (US); Rakesh Radhakrishnan, Vernon, CT (US); Xiaomei Yu, Glastonbury, CT (US)

(73) Assignee: Carrier Corporation, Farmington, CT (US)

( * ) Notice: Subject to any disclaimer, the term of this patent is extended or adjusted under 35 U.S.C. 154(b) by 558 days.

(21) Appl. No.: 11/990,591

(22) PCT Filed: Aug. 15, 2005

(86) PCT No.: PCT/US2005/028888

§ 371 (c)(1), (2), (4) Date: Feb. 15, 2008

(87) PCT Pub. No.: WO2007/021273

PCT Pub. Date: Feb. 22, 2007

(65) Prior Publication Data

US 2009/0100842 A1 Apr. 23, 2009

(51) Int. Cl.
*F25B 21/02* (2006.01)

(52) U.S. Cl. ..... 62/3.3; 62/3.2; 62/332

(58) Field of Classification Search ..... 62/332, 62/3.2, 3.3, 3.6, 498

See application file for complete search history.

(56) References Cited

U.S. PATENT DOCUMENTS

| | | | | |
|---|---|---|---|---|
| 6,079,485 | A * | 6/2000 | Esaki et al. | 165/43 |
| 6,213,198 | B1 | 4/2001 | Shikata et al. | 165/202 |
| 6,272,873 | B1 | 8/2001 | Bass | 62/238.3 |
| 6,351,950 | B1 * | 3/2002 | Duncan | 62/3.2 |
| 6,434,955 | B1 | 8/2002 | Ng et al. | 62/106 |
| 7,240,494 | B2 * | 7/2007 | Akei et al. | 62/3.2 |
| 7,310,953 | B2 * | 12/2007 | Pham et al. | 62/3.2 |

OTHER PUBLICATIONS

International Search Report issued Jan. 13, 2006 for PCT/US2005/028888.

* cited by examiner

*Primary Examiner* — Melvin Jones
(74) *Attorney, Agent, or Firm* — Cantor Colburn LLP

(57) ABSTRACT

A heating and cooling system to maintain an area at a desired temperature including a thermoelectric device (102), a vapor compression system (106), and a control system (104) operably connected to the thermoelectric device (102) and the vapor compression system (106).

16 Claims, 1 Drawing Sheet

HYBRID THERMOELECTRIC-VAPOR COMPRESSION SYSTEM

BACKGROUND OF THE INVENTION

1. Field of the Invention

The present invention is related to heating and cooling systems. More particularly, a method and apparatus is provided for a heating and cooling system with both vapor compression and thermoelectric heating and cooling.

2. Description of Related Art

Generally, heating and cooling systems generate heated or cooled air through a vapor compression cycle. A vapor compression cycle is ideal at large loads. However, there is evidence that thermoelectric cooling could be preferable for small loads. This is based on easy modularity of thermoelectric cooling device which offers an increased coefficient of performance (COP) at low loads compared to traditional vapor compression cycles designed for large load operation.

Thermoelectric cooling provides advantages over vapor compression cycles such as low noise operation, higher reliability due to few moving parts and decreased component maintenance, fine tune control of temperature, faster response to temperature control settings, reduced size, and reduced refrigerant usage leading to decreased environmental impact.

Accordingly, a heating and cooling system to maintain an area at a desired temperature including a vapor compression system having a vapor compression cycle and a thermoelectric device may be utilized to provide energy efficient modes of operation where dynamic COP is maximized.

BRIEF SUMMARY OF THE INVENTION

It is an object of the present invention to provide a hybrid thermoelectric-vapor compression system.

It is another object of the present invention to provide a hybrid thermoelectric-vapor compression system having a dynamic mode of operation.

It is still another object of the present invention to provide a hybrid thermoelectric-vapor compression system having a dynamic mode of operation using a vapor compression system having a vapor compression cycle and a thermoelectric device.

It is still another object of the present invention to provide a hybrid thermoelectric-vapor compression system having a dynamic mode of operation with a vapor compression system having a vapor compression cycle operating to meet larger loads and a thermoelectric device to meet smaller loads.

It is a further object of the present invention to provide a hybrid thermoelectric-vapor compression system having a dynamic mode of operation with a vapor compression system having a vapor compression cycle operating to meet loads greater than or equal to 1 kilowatt and a thermoelectric device to meet loads less than 1 kilowatt.

It is still a further object of the present invention to provide a hybrid thermoelectric-vapor compression system to optimize COP to save energy.

It is still a further object of the present invention to provide a hybrid thermoelectric-vapor compression system to reduce noise.

It is still a further object of the present invention to provide a hybrid thermoelectric-vapor compression system to provide higher reliability due to lesser use of the moving parts in a vapor compression cycle that help meet small transient loads in normal stand alone vapor compression cooling systems.

It is still a further object of the present invention to provide a hybrid thermoelectric-vapor compression system for fine tune control of temperature.

It is still a further object of the present invention to provide a hybrid thermoelectric-vapor compression system for faster response to temperature control settings.

It is still a further object of the present invention to provide a hybrid thermoelectric-vapor compression system to reduce refrigerant usage and environmental impact.

These and other objects are provided by a heating and cooling system to maintain an area at a desired temperature including a thermoelectric device, a vapor compression system, and a control system operably connected to the thermoelectric device and the vapor compression system. The control system has temperature sensors for monitoring a temperature of the area. The control system evaluates a thermal load of the area. The control system activates the vapor compression system when the thermal load in the area is greater than an operating load. The control system activates the thermoelectric device when the thermal load in the area is less than the operating load.

A method of heating and cooling an area to a desired temperature is also provided. The method includes monitoring a temperature of the area, comparing the temperature to the desired temperature, determining an adjustment load based upon a comparison of the temperature and the desired temperature, activating a vapor compression system to meet the adjustment load when the adjustment load is greater than or equal to a predetermined load, and activating a thermoelectric device to meet the adjustment load when the adjustment load is less than the predetermined load.

The above-described objects and other features and advantages of the present invention are appreciated and understood by those skilled in the art from the following detailed description, drawings, and appended claims.

DETAILED DESCRIPTION OF THE INVENTION

Figure 1:
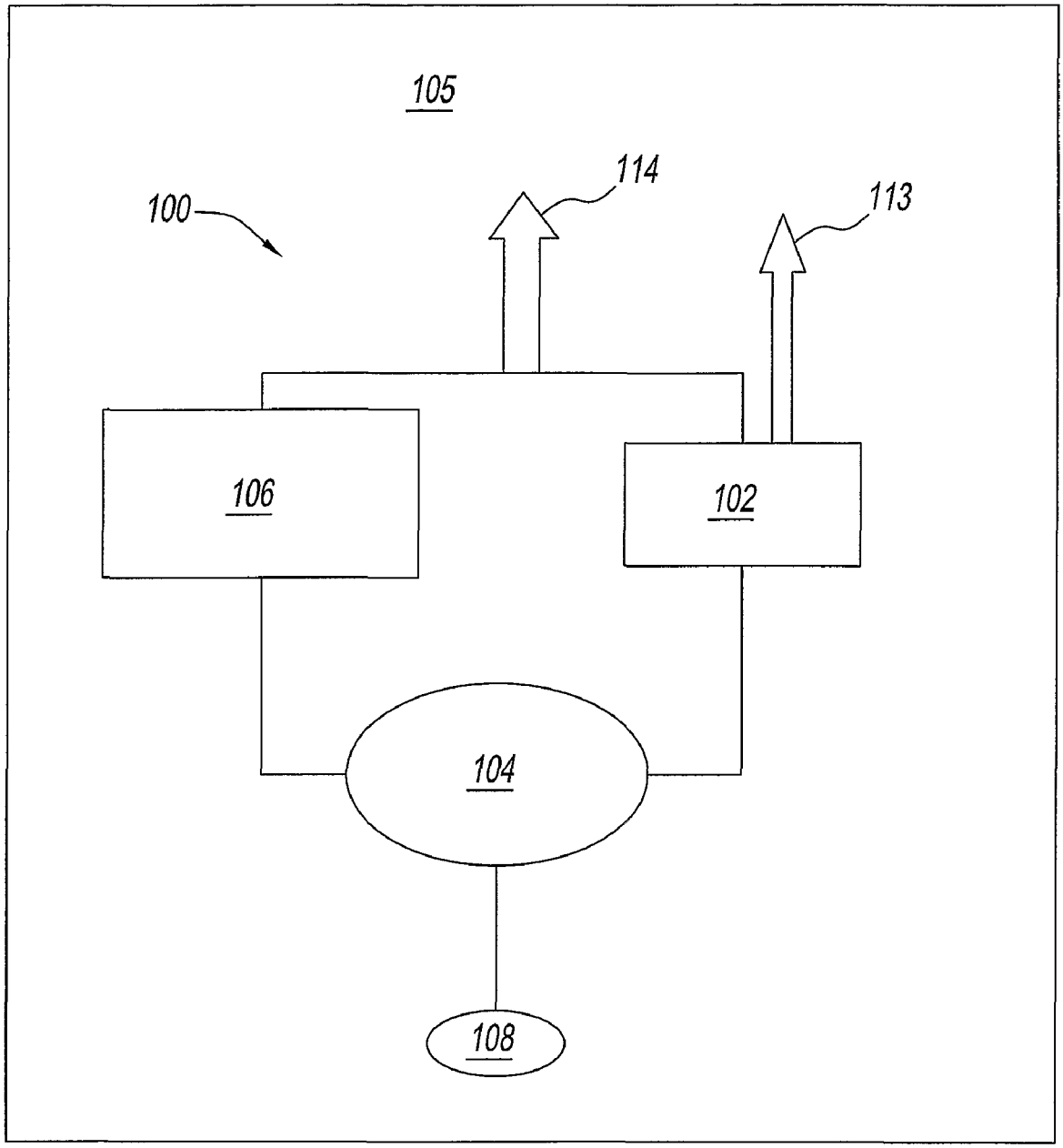
FIG. 1 schematically depicts a hybrid thermoelectric-vapor compression system of the present invention.

Referring to the drawings and, in particular, FIG. 1, there is shown an exemplary embodiment of a hybrid thermoelectric-vapor compression system of the present invention generally represented by reference numeral 100. System 100 performs temperature adjustment or heating and cooling, preferably, where there are large pull down loads and smaller steady state loads, e.g., for beverage coolers, super market food and beverage cases, hot and cold beverage dispensers, and stationary and mobile indoor structures.

In the exemplary embodiment, system 100 has a control system 104 to provide a dynamic mode of operation. Control system 104 monitors a controlled temperature of a temperature controlled area 105 through the use of temperature sensors or the like. A predetermined, desired temperature may be inputted into control system 104. Upon the controlled temperature of area 105 being outside of a range of the predetermined temperature, control system 104 activates vapor compression system 106 or thermoelectric device 102 to adjust the controlled temperature to the predetermined temperature or within the range of the predetermined temperature. The range of the predetermined temperature may be, for example, 1 degree above and below the predetermined temperature. In the preferred embodiment, vapor compression system 106 and thermoelectric device 102 include components known in the art for such systems, such as, for example, a compressor, evaporator, and condenser for vapor compression system 106 and a power supply and thermoelectric materials for thermoelectric device 102.

Alternatively, there may be several methods for implementing system 100 from a thermal management perspective. One such method is that thermoelectric device 102 may utilize the cooling loop of vapor compression system 106 to remove heat generated by thermoelectric device 102 during a cooling mode system operation, thus eliminating redundancy of peripheral heat exchanger devices. Alternately, vapor compression system 106 and one or more of thermoelectric device 102 could be stand alone systems that are operated independently or in tandem to meet the requisite cooling loads.

Thermoelectric device 102 may provide heat as represented by arrow 113 or may provide cooling as represented by arrow 114 to temperature controlled area 105 by heating or cooling the surrounding air or by direct contact with the temperature controlled area. Thermoelectric device 102 may be any thermoelectric device known in the art. Preferably, thermoelectric device 102 can operate with loads of less than or equal to 300 watts, and more preferably, 1 kilowatt. However, improved thermoelectric technology in terms of COP may increase the heating and cooling capacity of thermoelectric device 102 at the same power consumption. Thermoelectric device 102 may provide heating, for example, to meet part of a heating load during winter months. Thermoelectric device 102 may be a traditional thermoelectric module and could also be a thermoelectric integrated into various heat exchanger designs including air-air, air-liquid, liquid-liquid etc.

Vapor compression system 106 may be any known system using a vapor compression cycle or vapor compression heating or cooling to provide heat 113 or provide cooling 114 to the air surrounding the dertermined temperature area 105. Preferably, vapor compression system 106 can operate with loads of at least 1 kilowatt, and more preferably, greater than 5 kilowatts.

Control system 104 activates vapor compression system 106 or thermoelectric device 102 based on an adjustment load required to adjust the controlled temperature to the predetermined temperature or within the range of the predetermined temperature for area 105. Control system 104 may activate vapor compression system 106 to perform heating and cooling operations for adjustment loads above a predetermined or operating load, e.g. 1 kilowatt. Control system 104 may activate thermoelectric device 102 to perform heating and cooling operations for adjustment loads below the predetermined or operating load. The particular value of the predetermined or operating load may be determined by operating control system 104 or may be inputted to the control system.

Preferably, vapor compression system 106 performs heating and cooling operations for large adjustment loads and temperature variations, e.g. upon activation of system 100. Thermoelectric device 102, preferably, performs heating and cooling operations for smaller adjustment loads and temperature variations to maintain the predetermined temperature or finely control the controlled temperature for area 105. Such a dual system is particularly suited for refrigeration or heating demands where there is a need for a large pull down load but a smaller steady state load.

Control system 104 may deactivate vapor compression system 106 upon the predetermined temperature being met or the adjustment load being reduced below the predetermined load. Control system 104 may deactivate thermoelectric device 102 upon the controlled temperature being equal to the predetermined temperature or the controlled temperature being within the range of the predetermined temperature. Thus, vapor compression cycling and temperature variation is minimized while COP may be optimized. Moreover, system 100 may operate to reduce noise, provide higher reliability due to decreased component maintenance, provide fine tune control of temperature; provide faster response to temperature control settings, reduce size, and reduce refrigerant usage leading to reduced pollution through use of the more efficient thermoelectric device 102 when the heating or cooling requirements allow for temperature control by the thermoelectric device 102. Control system 104 also monitors the temperature of area 105 and provides for control of the heating or cooling of the area 105 so as to avoid or limit cycling.

System 100 may have a power supply 108 supplying power to thermoelectric device 102 and vapor compression system 106. In the preferred embodiment, power supply 108 also supplies power to control system 104. Power supply 108 may be an assembly to connect system 100 to an existing power grid, or any mobile power source such as a fuel cell, a fuel or heat driven generator, internal combustion, solar electricity, a battery bank or any combination thereof.

While the present invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A heating and cooling system to maintain an area at a desired temperature comprising:

a thermoelectric device;

a vapor compression system;

a control system operably connected to said thermoelectric device and said vapor compression system and having temperature sensors for monitoring a temperature of the area, wherein said control system activates said vapor compression system when said thermal load in the area is greater than an operating load, and wherein said control system activates said thermoelectric device when said thermal load in the area is less than said operating load; and a power supply connected to said thermoelectric device and said vapor compression system;

wherein said power supply is selected from the group consisting of a power grid, a fuel cell, a fuel or heat driven generator, internal combustion, solar electricity, battery bank, and any combination thereof.

2. A heating and cooling system to maintain an area at a desired temperature comprising:

a thermoelectric device;

a vapor compression system:

a control system operably connected to said thermoelectric device and said vapor compression system and having temperature sensors for monitoring a temperature of the area, wherein said control system activates said vapor compression system when said thermal load in the area is greater than an operating load, and wherein said control system activates said thermoelectric device when said thermal load in the area is less than said operating load;

wherein said operating load is 1 kilowatt.

3. The system of claim 2, wherein said control system deactivates said vapor compression system (when said thermal load is less than 1 kilowatt.

4. The system of claim 1, wherein said vapor compression system comprises a compressor, an evaporator, and a condensor.

5. A heating and cooling system to maintain an area at a desired temperature comprising:

a thermoelectric device;

a vapor compression system:

a control system operably connected to said thermoelectric device and said vapor compression system and having temperature sensors for monitoring a temperature of the area, wherein said control system activates said vapor compression system when said thermal load in the area is greater than an operating load, and wherein said control system activates said thermoelectric device when said thermal load in the area is less than said operating load;

wherein said control system determines said thermal load based upon data from said temperature sensors and a user's input of the desired temperature.

6. A heating and cooling system to maintain an area at a desired temperature comprising:

a thermoelectric device;

a vapor compression system;

a control system operably connected to said thermoelectric device and said vapor compression system and having temperature sensors for monitoring a temperature of the area, wherein said control system activates said vapor compression system when said thermal load in the area is greater than an operating load, and wherein said control system activates said thermoelectric device when said thermal load in the area is less than said operating load;

wherein said vapor compression system and one or more of said thermoelectric device are stand alone systems operated independently or in tandem to meet said thermal load.

7. A heating and cooling system to maintain an area at a desired temperature comprising:

a thermoelectric device;

a vapor compression system;

a control system operably connected to said thermoelectric device and said vapor compression system and having temperature sensors for monitoring a temperature of the area, wherein said control system activates said vapor compression system when said thermal load in the area is greater than an operating load, and wherein said control system activates said thermoelectric device when said thermal load in the area is less than said operating load;

wherein said thermoelectric device utilizes a cooling loop of said vapor compression system to remove heat generated by said thermoelectric device during a cooling mode system operation.

8. A method of heating and cooling an area to a desired temperature comprising:

monitoring a temperature of the area;

comparing said temperature to the desired temperature;

determining an adjustment load based upon a comparison of said temperature and the desired temperature;

activating a vapor compression system to meet said adjustment load when said adjustment load is greater than or equal to a predetermined load; and activating a thermoelectric device to meet said adjustment load when said adjustment load is less than said predetermined load.

9. The method of claim 8, further comprising inputting the desired temperature.

10. The method of claim 9, further comprising inputting said predetermined load.

11. The method of claim 8, further comprising deactivating said vapor compression system upon said adjustment load being less than said predetermined load.

12. The method of claim 8, further comprising deactivating said thermoelectric device upon said adjustment load being greater than said predetermined load.

13. The method of claim 8, further comprising providing power to both said thermoelectric device and said vapor compression system from a single power supply.

14. The method of claim 13, wherein said power supply is selected from the group consisting of a power grid, a fuel cell, fuel or heat driven generator, internal combustion, solar electricity, batter bank, and any combination thereof.

15. The method of claim 8, wherein said predetermined load is 1 kilowatt

16. The method of claim 8, wherein said vapor compression system uses vapor compression heating and/or cooling generated by a condenser, a compressor, and a evaporator connected to each other.

* * * * *